United States Patent [19]

Langen et al.

[11] Patent Number: 4,536,151

[45] Date of Patent: Aug. 20, 1985

[54] MIXTURE PREPARATION FOR ENGINE-INDEPENDENT HEATERS

[75] Inventors: Herbert Langen, Altbach; Peter Reiser; Erich Kenner, both of Esslingen, all of Fed. Rep. of Germany

[73] Assignee: J. Eberspächer, Fed. Rep. of Germany

[21] Appl. No.: 550,135

[22] Filed: Nov. 9, 1983

[30] Foreign Application Priority Data

Dec. 1, 1982 [DE] Fed. Rep. of Germany ..... 3244405

[51] Int. Cl.[3] ..... F23C 11/04

[52] U.S. Cl. ..... 431/1; 431/264; 431/354; 237/12.3 C; 123/198 R

[58] Field of Search ..... 431/1, 173, 175, 176, 431/263, 264, 266, 354; 237/12.3 R, 12.3 C; 126/110 B; 123/198 R

[56] References Cited

U.S. PATENT DOCUMENTS 2,370,345 2/1945 Frost ..... 431/264
3,276,505 10/1966 Huber et al. ..... 431/1
3,796,536 3/1974 Hori et al. ..... 431/1

FOREIGN PATENT DOCUMENTS 1215851 5/1966 Fed. Rep. of Germany ..... 431/1
104040 8/1979 Japan ..... 431/1

*Primary Examiner*—Margaret A. Focarino
*Attorney, Agent, or Firm*—McGlew and Tuttle

[57] ABSTRACT

An engine-independent heater, particularly a space heater for automobiles comprises a housing which includes a combustion chamber and an antechamber which is tangentially connected into the combustion chamber. The antechamber receives a fuel and air mixture which is ignited in the antechamber and directed into the main combustion chamber. The construction includes the housing carrying an ultrasonic vibrator which is actuated in order to intermix air which is drawn into the housing for the vibrator with fuel which is directed against the vibrator so that the coolant air intermix has there delivered into the antechamber of the heater. The construction includes a nipple connection into the antechamber which sprays fuel from a proportioning pump into the vicinity of the ultrasonic vibrator.

2 Claims, 1 Drawing Figure

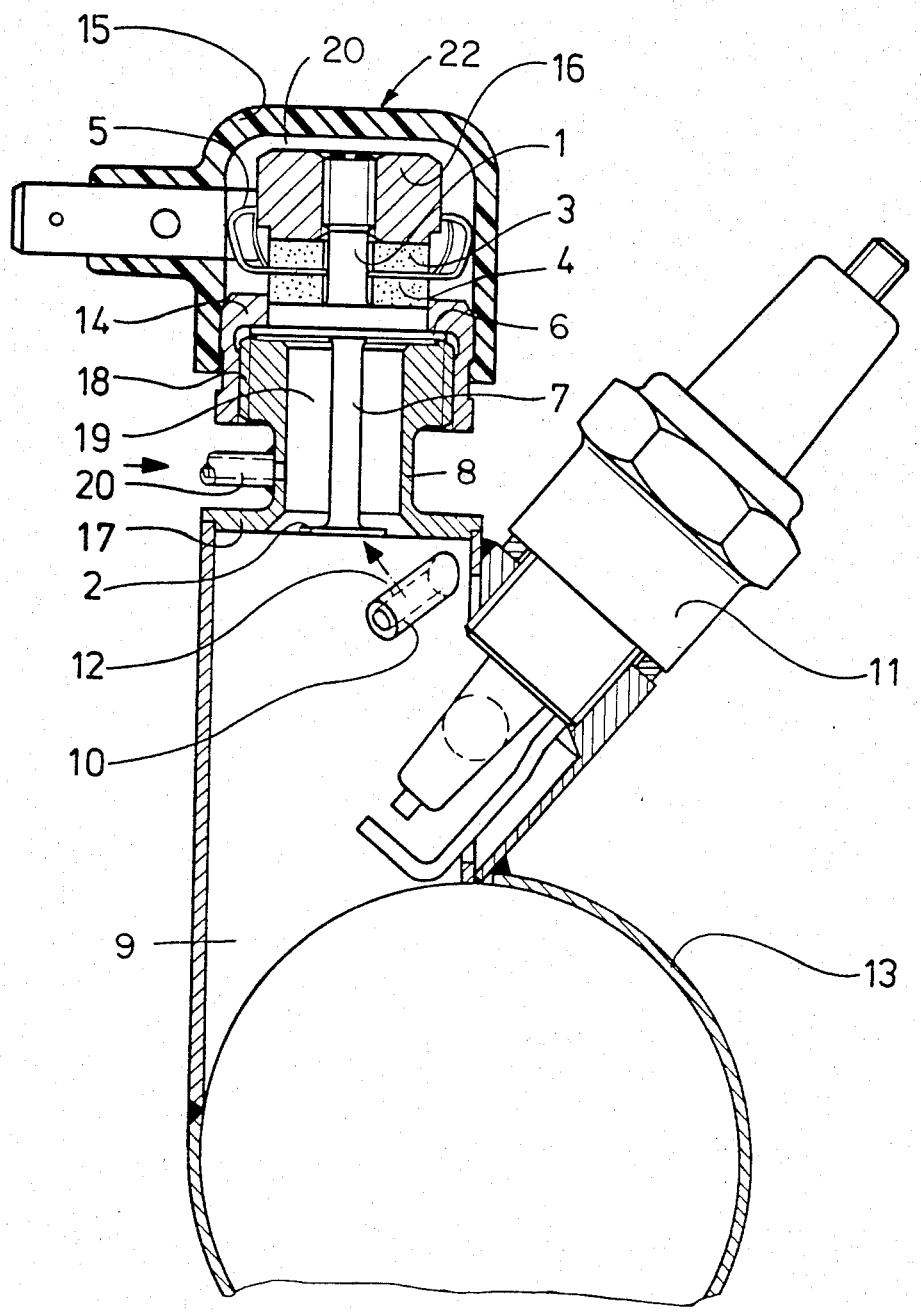
15
20
22
16
5
1
3
4
14
6
18
7
19
20
8
17
2
12
10
11
9
13

MIXTURE PREPARATION FOR ENGINE-INDEPENDENT HEATERS

FIELD AND BACKGROUND OF THE INVENTION

This invention relates, in general, to the construction of space heaters and, in particular, to a new and useful engine-independent space heater, particularly for automobiles which includes a mixture preparation device.

The invention relates to a device for mixture preparation in engine-independent heaters, having a combustion chamber and an antechamber thereof into which an ignition device protrudes to ignite the prepared explosive mixture and which antechamber cooperates with a combustion chamber.

In engine-independent heaters, good mixture preparation for ignition and combustion of the fuel-air mixture is especially important because naturally the efficiency of the heater depends on it. What is required of such heaters is in particular that they must be operational in a wide temperature range and be able to be operated with a minimum of current consumption, as the current supply is from the vehicle's own battery.

Another requirement is that the relatively small fuel quantities are supplied reliably and are prepared for operation with an adequate proportion of combustion or start-up air.

Engine-independent heaters are known where the fuel supply and preparation is effected through a fuel nozzle. These nozzles are high-pressure atomizer nozzles. Their operation shows a relatively high current consumption, because the fuel must first be brought to the high pressure required for the atomization by the fuel nozzle. For small heaters another difficulty is that the required small nozzles—for quantities in the range of below about 2.5 l/hr, in particular 0.3 l/h—are not available.

Further heaters are known where the mixture preparation occurs through a so-called rotary distributor, a disk on which the fuel is applied during its rotation at high speed. Since the fuel preparation and ignition occurs in the hot part of the heater, this means that movable parts, namely the rotary distributor, are exposed to high temperatures.

Also in the operation of heaters where the ignition of th fuel-air mixture occurs through an incandescent coil, the disadvantage of high current consumption occurs. Another factor is a dependence of such arrangements on voltage differences, leading to higher trouble proneness. An object of the invention is to provide a device for mixture preparation in engine-independent heaters which can take the place of the high-pressure atomizer nozzle or rotary distributor serving for mixture formation and which does not have the disadvantages thereof and in particular has a low current consumption or can replace an arrangement with ignition by an incandescent coil.

SUMMARY OF THE INVENTION

The invention provides a device, where in engine-independent heaters, the mixture preparation is effected by an ultrasonic vibrator, the fuel being applied on the vibratory plate thereof. With this device according to the invention, virtually any quantities of fuel, in particular small quantities, say 0.3 l/h to 2.5 l/h, can be prepared in such a way that reliable ignition can take place, a special advantage being a low current consumption.

In a particular appropriate embodiment of the invention, the ultrasonic vibrator, comprising two ceramic disks with interposed common electric contact and, toward the vibratory plate, a flanged plate and following transfer element to the vibratory plate, is clamped by its flanged plate in a support part attached on the combustion antechamber. Thereby, an especially good clamping of the ultrasonic vibrator is achieved, this being important for the operation of the vibrator. In this connection, it has been found to be advantageous that the fuel supply to the ultrasonic vibrator occurs via a nipple protruding into the combustion antechamber, the fuel being supplied through a proportioning pump and being sprayed into the vibratory plate. While in known devices for the atomization of a liquid medium the supply to the vibratory plate occurs through a borehole in the transfer element of the ultrasonic vibrator, which requires, as a rule, that the medium be connected at right angles thereto, the design according to the invention has the advantage that the fuel supply is effected by means of a totally unproblematical nipple. According to a development of the invention, this nipple protrudes into the combustion antechamber and is closed at its end face and has a fuel outlet opening and is inclined relatively to the vibratory plate under an angle of less than 90°, preferably 30°-50°. Thereby a safe spraying onto the vibratory plate is achieved and dripping of fuel from the nipple is avoided. By the proposed arrangement of the nipple, it is achieved in addition that the mist, i.e. the prepared fuel-air mixture, is supplied to the spark plug required for ignition in a quieted zone, which lets the ignition process be especially safe and reliable. According to the invention, the combustion antechamber air required for the mixture formation is supplied via the support part, at one end of which the ultrasonic vibrator is clamped. To this end, the support part forms a channel, in the axis of which lies the transfer element of the ultrasonic vibrator and which is traversed by the antechamber air. Due to the sweeping of the vibratory plate at the exit of the antechamber air into the combustion antechamber, conditions especially favorable for the mixture preparation result, which can possibly be further improved by the geometry of the vibratory plate or adapted to certain particularities.

Accordingly, it is an object of the invention to provide an engine-independent space heater which includes an ultrasonic vibrator which is arranged to produce an air flow through the housing thereof to aid in causing fuel which is sprayed to the vibrator to form a fuel and air mixture which is directed into an antechamber of the combustion heater.

A further object of the invention is to provide a device for the preparation of mixtures in self-fired heaters which is simple in design, rugged in construction and economical to manufacture.

BRIEF DESCRIPTION OF THE DRAWINGS

For an understanding of the principles of the invention, reference is made to the following description of a typical embodiment thereof as illustrated in the accompanying drawings.

In the Drawings:

The only figure of the drawings is a partial sectional view through a space heater constructed in accordance with the invention.

GENERAL DESCRIPTION OF THE PREFERRED EMBODIMENTS

Referring to the drawings, in particular, the invention embodied therein comprises a space heater, particularly for automobiles which is designed to operate independently of the engine of the automobile. The space heater includes the housing defining a main substantially cylindrical combustion chamber 13 and an antechamber 9 which connects tangentially into the main combustion chamber. Ignition means in the form of a spark plug 11 is mounted on the antechamber in a position to ignite a fuel and oil mixture which is delivered thereto.

In accordance with the invention, an ultrasonic vibrator housing 22 containing an ultrasonic vibrator 1 is mounted at the outer end of the antechamber 9. The ultrasonic vibrator 1 includes a vibrating plate 6 connected through a transfer element or connecting rod 7 to another vibrating member 2. Means are provided for directing combustion air into the ultrasonic housing in a space 20 between the ultrasonic vibrator 1 and the outer housing cover 15. This combustion air is admixed with fuel which is directed into the combustion chamber antechamber 9 in the vicinity of the vibrator by nipple means which includes a tubular member 10 having a spray opening 12 which directs the fuel in the vicinity of the plate portion 2 of the vibrator 1. The ultrasonic vibrator is actuated to cause the fuel to mix with the combustion air and to aid in directing it into the antechamber 9 for combustion therein.

The feature of the invention is the construction of the vibrator housing which includes cover portion 15 which is threaded to the clamping element 14 by a thread. The clamping element 14, in turn, is connected to a support part 8 which is mounted directly at the end of the antechamber 9. A vibratory plate 6 is held between the clamping element and the support part.

In the illustrated example, the combustion antechamber 9 is tangentially connected to the combustion chamber 13. In this example, the spark plug 11 protrudes into the combustion antechamber 9 at an angle of around 40° to the antechamber axis. By the air conduction in space 9 as a reverse flushing and with a certain air velocity and air quantity, the fuel-air ratio is determined, which is ignited by the spark plug 11. Attached to chamber 9 is a support part 8. The support part 8 is provided in its upper section with a thread for screwing on of the clamping element 14, over which a cover 15 consisting of non-metallic material is arranged. Between the support part 8 and the clamping element 14 the ultrasonic vibrator 1 is clamped by its flanged plate 6. This ultrasonic vibrator 1 consists of two ceramic disks 3 and 4 between which the common electric contact 5 is arranged, and of a placed-on steel part 16. In the direction of the combustion chamber there follows contiguous to the flanged plate 6, a transfer element 7, at which a vibratory plate 2 on its inner end forms the closure. This vibratory plate 2 lies in the entrance plane of the combustion antechamber 9. The support plate 8 is formed as a tubular piece with flange 17 and on the other side with the thread 18. Through the interior 19 of the support element 8 the antechamber air is supplied, which is supplied to a space 20 sweeping the vibratory plate 2. Admission of the fuel occurs via a nipple 10 closed at the end face, in which a fuel outlet opening 12 is arranged in such a way that the fuel delivery occurs directly onto the vibratory plate 2.

While specific embodiments of the invention have been shown and described in detail to illustrate the application of the principles of the invention, it will be understood that the invention may be embodied otherwise without departing from such principles.

What is claimed is:

1. A space heater, particularly for automobiles, comprising a housing defining a combustion chamber, an antechamber housing defining an antechamber extending tangentially into said housing combustion chamber, ignition means in said antechamber for igniting a fuel and air explosive mixture, an ultrasonic vibrator housing connected into said antechamber, an ultrasonic vibrator in said ultrasonic vibrator housing including a vibratory plate, means for directing combustion air into said ultrasonic housing adjacent said vibratory plate, and means in said antechamber for directing a fuel toward said vibratory plate for admixture with the air moved by said plate to form a fuel and air mixture which is directed into said antechamber.

2. A space heater according to claim 1, wherein said vibratory housing includes a hollow tubular support part connected to one end of said antechamber housing, a clamping element threadably engaged with said support part on the end thereof opposite to the connection to said antechamber and a cover member overlying the support part and threadably engaged therewith, said ultrasonic vibrator including said clamping element connected to said cover and threadably engaged with said support part over said vibratory plate.

* * * * *